United States Patent [19]

Lonardi et al.

[11] Patent Number: 4,859,131

[45] Date of Patent: Aug. 22, 1989

[54] SUPPORTING FRAMEWORK FOR A LOADING INSTALLATION OF A SHAFT FURNACE

[75] Inventors: Emile Lonardi, L-Bascharage; Pierre Mailliet, L-Howard, both of Luxembourg

[73] Assignee: Paul Wurth S.A., Luxembourg

[21] Appl. No.: 168,893

[22] Filed: Mar. 16, 1988

[30] Foreign Application Priority Data

Mar. 24, 1987 [LU] Luxembourg ..... 86820

[51] Int. Cl.[4] ..... B65B 1/28

[52] U.S. Cl. ..... 414/200; 266/184; 137/59; 137/244

[58] Field of Search ..... 177/58, 59, 2.44; 266/176, 184; 191/83; 414/200, 221; 198/502.1; 248/317, 542, 610

[56] References Cited

U.S. PATENT DOCUMENTS

| | | | |
|---|---|---|---|
| 853,698 | 5/1907 | Hunter | 266/176 |
| 4,322,197 | 3/1982 | Mahr et al. | 266/184 X |
| 4,431,071 | 2/1984 | Magat et al. | 177/59 X |
| 4,514,129 | 4/1985 | Legille et al. | 222/503 X |
| 4,614,213 | 9/1986 | Englin | 141/83 X |
| 4,728,240 | 3/1988 | Mahr et al. | 414/200 X |

*Primary Examiner*—Andres Kashnikow
*Assistant Examiner*—Kevin P. Weldon
*Attorney, Agent, or Firm*—Fishman, Dionne & Cantor

[57] ABSTRACT

The loading installation comprises a device for introducing and distributing charge material into a shaft furnace, this device being surmounted in ascending order, and in alignment with the central axis of the furnace, by a compensator, a valve housing, a lock chamber having a weighing system and a stand-by hopper. The lock chamber and the valve housing are suspended by means of several balances on a circular or polygonal horizontal supporting beam with the stand-by hopper resting on this beam. In turn, the supporting beam is carried by several vertical pillars with the pillars being carried by the head of the furnace.

5 Claims, 2 Drawing Sheets

SUPPORTING FRAMEWORK FOR A LOADING INSTALLATION OF A SHAFT FURNACE

BACKGROUND OF THE INVENTION

This invention relates to a supporting framework for a loading installation of a shaft furnace. More particularly, this invention relates to a new and improved supporting framework comprising a device for introducing and distributing load material into a furnace. This distribution device is surmounted in ascending order, and in alignment with the central axis of the furnace, by a compensator, by a valve housing, by a lock chamber equipped with a weighing system and by a stand-by hopper.

A central loading installation of this type is disclosed in. EP-Bl-0,062,770, corresponding to U.S. Pat. No. 4,514,129, assigned to the assignee hereof all of the contents of which are incorporated herein by reference. It will be appreciated that the structure which is to support a loading installation of the type shown in U.S. Pat. No. 4,514,129 must meet several criteria which are sometimes difficult to continuously satisfy. In fact, irrespective of the weight of the mass to be supported (several hundred tons), allowance must be made for the fact that the lock chamber must be weighed and that the lock chamber must therefore be independent of both the furnace and the stand-by hopper (in static terms).

In addition, it will also be appreciated that, because of the extremely high temperatures and enormous masses, the shaft furnace moves horizontally and vertically (although these movements are relatively slight). Furthermore, the supporting structure must be designed to allow safe and easy access to the various components and make it possible to replace these components.

On the other hand, if the stand-by hopper is of the rotary type, it is important to have a supporting framework with a very rigid rolling bearing in order to prevent excessive deformations which would cause a reduction in the bearing lifetime as well as jamming of the bearing. It will be appreciated that existing supporting frameworks do not satisfactorily meet all of these criteria.

SUMMARY OF THE INVENTION

The above-discussed and other drawbacks and deficiencies of the prior art are overcome or alleviated by the novel supporting framework for the loading installation of a shaft furnace of the present invention. In accordance with the present invention, the problems of prior art supporting frameworks are solved in a relatively simple manner by mounting on a shaft furnace, and in alignment with the central vertical axis of the furnace, in ascending order, a charge material distribution device, a compensator, a valve housing, a locking chamber having a weighing system and a stand-by hopper. In addition, and in accordance with a preferred embodiment of the present invention, the lock chamber and the valve housing are suspended by means of several balances on a circular or polygonal horizontal supporting beam with the stand-by hopper resting on the supporting beam. This beam is carried by several vertical pillars with the pillars being supported by the head of the furnace.

Preferably, the lock chamber is suspended on four balances, and the supporting beam is preferably carried by four pillars.

The framework is preferably connected on one side to various levels of access scaffolding (which does not perform a support function). However, the scaffolding does support flights of steps which are carried by a square tower surrounding the furnace and which do not exceed the height of the furnace.

The above-discussed and other features and advantages of the present invention will be appreciated and understood by those of ordinary skill in the art from the following detailed description and drawings.

BRIEF DESCRIPTION OF THE DRAWINGS

Referring now the the drawings, wherein like elements are numbered alike in the several FIGS..

DESCRIPTION OF THE PREFERRED EMBODIMENT

Figure 1:
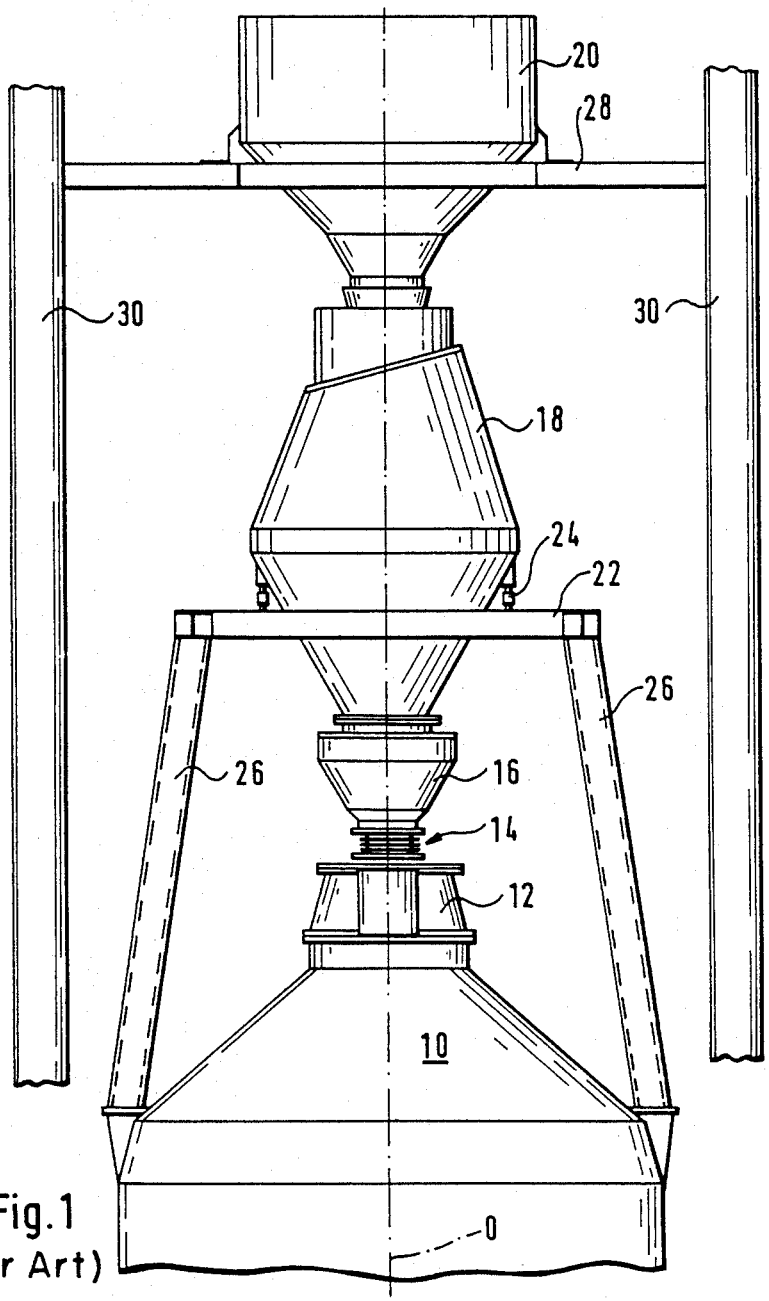
Fig.1 (Prior Art)
FIG. 1 is a diagrammatic view of supporting framework in accordance with the prior art for a loading installation of a shaft furnace.

The installation illustrated in FIG. 1 is a loading installation of the central-loading type such as described in U.S. Pat. No. 4,514,129. This prior art apparatus comprises, above the furnace 10 and in alignment with the central axis 0 of the furnace, a device 12 for introducing and distributing the loading or charge material (which is preferably a discharge-chute or oscillating spout), a compensator 14, a valve housing 16, a lock chamber 18 and a stand-by hopper 20. Compensator 14 ensures a static cut-off between furnace 10 and lock chamber 18 so that the weighing of the furnace can be carried out.

Lock chamber 18 is supported by means of three or four balances 24 carried by a beam 22 which is arranged around the lock chamber and which is carried by four pillars 26. In turn pillars 26 are carried by the head of furnace 10.

It will be appreciated that stand-by hopper 20 cannot be carried by lock chamber 18 so as to permit lock chamber 18 to be weighed. Stand-by hopper 20 therefore has to be carried by another horizontal beam 28 which is supported by four pillars 30. Pillars 30 can then form part of the well known square tower arranged around the shaft furnace or alternatively can rest on the Square tower.

This conventional framework illustrated in FIG. 1 is relatively complicated, inasmuch as it consists of two horizontal beams 22 and 28 supported separately by independent and distinct vertical pillars. This makes it relatively difficult to gain access to the loading installation, especially by means of cranes; and this can cause problems with regard to removal of certain components of the loading installation. In addition, this conventional framework is more expensive.

Figure 2:
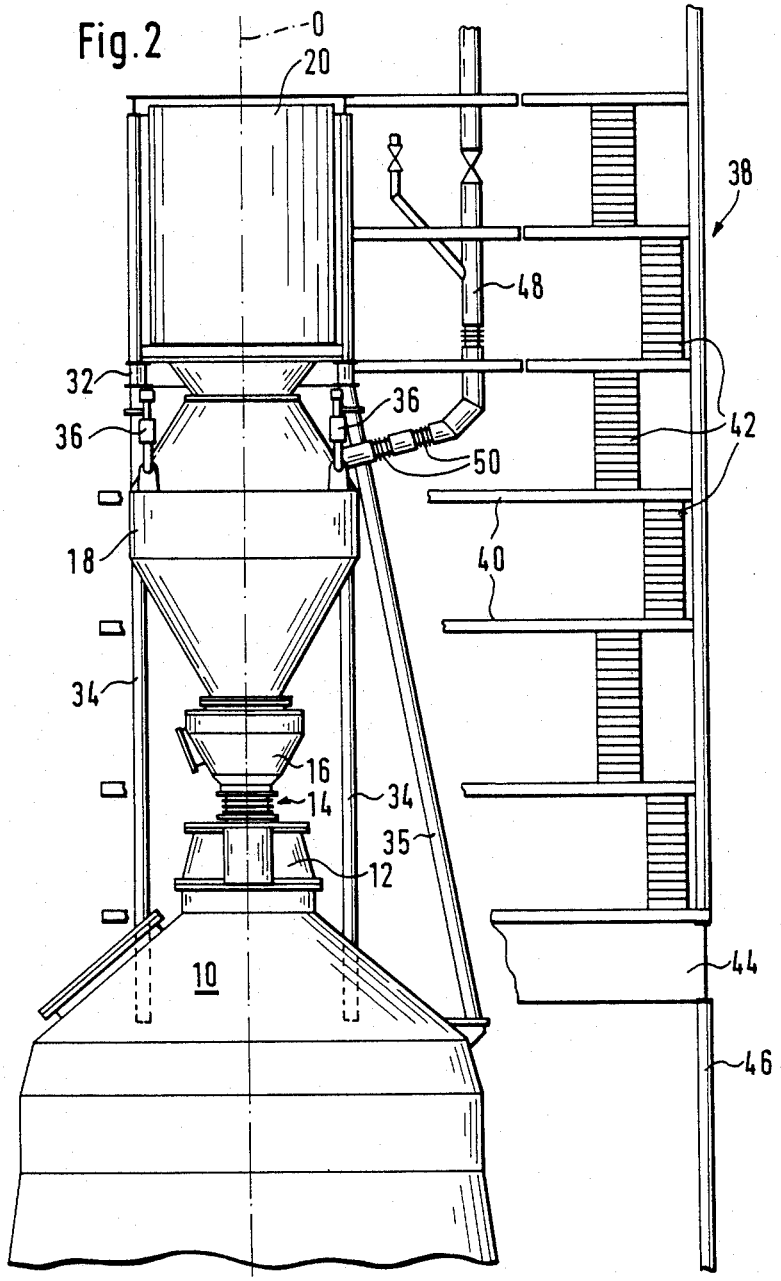
FIG. 2 is a diagrammatic view of a supporting framework in accordance with the present invention.

The loading installation of the present invention is illustrated in FIG. 2 and is formed in the same way as that of FIG. 1 and bears the same reference numerals as the latter for designating its essential components. In contrast to the structure of FIG. 1, the loading installation of FIG. 2 is supported by a framework designed in accordance with the present invention. The main part of this framework is a single horizontal supporting beam 32 which can be circular, square or rectangular. Beam 32 is supported by at least four vertical pillars 34 bearing on furnace 10 and, if appropriate, by an oblique pillar 35 for preventing the framework from being subjected to torsion. This single beam 32 supports both stand-by hopper 20 and lock chamber 18. Stand-by hopper 20 rests directly on beam 32 or rests via a rolling ring if it is designed to be driven in rotary movement about the vertical axis 0. Lock chamber 18 is suspended on beam 32 by means of several, preferably four balances 36, which make it possible to determine the content of the lock chamber by weighing.

The framework shown in FIG. 2 is associated with a scaffolding 38 having several levels 40 which extend from one side of the installation to the opposite side, surrounding it on either side, to allow access to the entire loading installation. The flights of steps serving various levels 40 are represented by the reference numeral 42. Scaffolding 38 is carried by a beam 44 resting, in the vicinity of the head of the furnace 10, on the square tower which is arranged around the furnace; and part of which is indicated diagrammatically at 46.

The supporting framework of the present invention and shown in FIG. 2 has many advantages over that of FIG. 1. First of all, it is much simpler because there is only a single horizontal supporting beam, whereas the conventional framework of FIG. 1 required two horizontal beams and also had to have pillars for supporting the second beam. Another advantage of the framework of FIG. 2 in comparison with that of FIG. 1 is that it is much narrower, thus making it possible for scaffolding 38 to also be much narrower and therefore have a substantially lighter construction.

Furthermore, another important feature of the present invention is that one side of the supporting framework of FIG. 2, (in this particular case, the left-hand side of the FIG.), is freed-up completely, thus making access to the various levels by means of a crane easier; and making dismantling simpler and quicker.

Still another advantage of the present invention is that the pipes 48 necessary for the ventilation and pressurisation of lock chamber 18 can be mounted much nearer the latter and on the same framework. As a result, the relative movements between the pipes 48 and lock chamber 18 caused by the need for lock chamber 18 to have freedom of vertical movement are much smaller, that is, the compensator 50 to be provided in these pipes are subjected to less stress and can therefore be smaller and, if appropriate, less numerous.

In conventional installations, square tower 46 normally rose as far as the top of the loading installation. In contrast, the supporting framework of the present invention, which rests on furnace 10, makes it possible for the square tower to terminate in the vicinity of the head of the furnace, thus reducing the construction costs.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Supporting framework for a loading installation of a shaft furnace having a central vertical axis comprising:

a charging device for introducing and distributing charge material into the head of the furnace, said charging device being in alignment with said central axis of the furnace, said charging device being surmounted in ascending order by a compensator having a valve housing, a lock chamber having a weighing system and a stand-by hopper;

a horizontal supporting beam;

a plurality of balances on said horizontal support beam; said valve housing being suspended on said horizontal supporting beam by said balances;

said stand-by hopper being supported on said horizontal supporting beam independent of said balances; and a plurality of vertical pillars, said horizontal supporting beam being carried by said vertical pillars, said vertical pillars being carried by the head of the furnace.

2. Framework according to claim 1 wherein:

said lock chamber is suspended on four balances; and said horizontal supporting beam is carried by four pillars

3. Framework according to claim 1 including:

access scaffolding supporting steps means; and said scaffolding being carried by a square tower surrounding only a portion of the furnace and said scaffolding not exceeding the height of said square tower.

4. Framework according to claim 1 wherein:

said horizontal supporting beam is circular.

5. Framework according to claim 1 wherein:

said horizontal supporting beam is polygonal.

* * * * *